United States Patent [19]

Kennedy et al.

[11] Patent Number: 4,964,618

[45] Date of Patent: Oct. 23, 1990

[54] FENCE SYSTEM AND COMPONENTS

[75] Inventors: Charles G. Kennedy; Patrick D. McKeown, both of Mansfield; Jack W. Neiger, Tuscarawas, all of Ohio

[73] Assignee: Cyclops Corporation, Pittsburgh, Pa.

[21] Appl. No.: 420,613

[22] Filed: Oct. 10, 1989

Related U.S. Application Data

[63] Continuation of Ser. No. 142,851, filed as PCT US86/01992 on Sep. 23, 1986, abandoned.

[51] Int. Cl.[5] ..... E04H 17/16

[52] U.S. Cl. ..... 256/24; 256/65; 256/73; 52/588

[58] Field of Search ..... 256/73, 24, 19, 21, 256/68, 69, 65, 66, 59, DIG. 5, 25; 52/588, 574, 74, 542

[56] References Cited

U.S. PATENT DOCUMENTS

| | | | |
|---|---|---|---|
| 2,007,374 | 7/1935 | Kuchne . | |
| 2,123,366 | 7/1938 | Kehr et al. . | |
| 2,271,871 | 2/1942 | Newport et al. . | |
| 2,740,613 | 4/1956 | Berliner | 256/24 X |
| 2,809,017 | 10/1957 | Wong | 256/73 |
| 2,877,600 | 3/1959 | Slate | 256/24 X |
| 2,919,113 | 12/1959 | Cofield | 256/65 |
| 3,120,376 | 2/1964 | Case | 256/24 |
| 3,136,530 | 6/1964 | Case | 256/24 |
| 3,157,255 | 11/1964 | Sondheim | 256/65 X |
| 3,195,864 | 7/1965 | Case | 256/65 |
| 3,232,372 | 2/1966 | Beschi . | |
| 3,258,250 | 6/1966 | McMullin . | |
| 3,267,626 | 8/1966 | Daly . | |
| 3,276,333 | 10/1966 | Blok | 256/24 X |
| 3,290,014 | 12/1966 | Stapleton | 256/73 |
| 3,303,622 | 2/1967 | Minds, Jr. | 256/24 X |
| 3,349,532 | 10/1967 | Dudoff | 256/65 X |
| 3,397,866 | 8/1968 | Hockett . | |
| 3,506,243 | 4/1970 | Seiler | 256/65 X |
| 3,524,292 | 8/1970 | Bottom | 52/588 X |
| 3,606,718 | 9/1971 | Curran | 52/542 |
| 3,630,310 | 12/1971 | Federer . | |
| 3,651,887 | 3/1972 | Eckel . | |
| 3,656,576 | 4/1972 | Gubela . | |
| 3,698,692 | 10/1972 | Burrows, Jr. | 256/19 |
| 3,847,489 | 12/1974 | Van Piper . | |
| 3,879,017 | 4/1975 | Maxcy et al. | 256/65 |
| 3,910,561 | 10/1975 | Fornells | 256/65 |
| 3,957,250 | 5/1976 | Murphy | 256/19 |
| 3,960,367 | 6/1976 | Rogers | 256/21 |
| 3,982,735 | 9/1976 | Fornells | 256/59 |
| 3,983,956 | 10/1976 | Manhart . | |
| 4,050,538 | 9/1977 | Desenfant . | |

(List continued on next page.)

FOREIGN PATENT DOCUMENTS

| | | | |
|---|---|---|---|
| 0067802 | 12/1982 | European Pat. Off. | 256/DIG. 5 |
| 1946561 | 4/1971 | Fed. Rep. of Germany . | |
| 2012519 | 10/1971 | Fed. Rep. of Germany . | |
| 2800529 | 7/1979 | Fed. Rep. of Germany . | |
| 2935745 | 7/1981 | Fed. Rep. of Germany . | |
| 3043876 | 9/1982 | Fed. Rep. of Germany . | |
| 3131104 | 2/1983 | Fed. Rep. of Germany . | |
| 3436402 | 4/1985 | Fed. Rep. of Germany . | |
| 2450410 | 10/1980 | France . | |
| 2560901 | 9/1985 | France . | |
| 1482517 | 8/1977 | United Kingdom | 256/66 |
| 1538955 | 1/1979 | United Kingdom | 256/24 |

OTHER PUBLICATIONS

International Patent Application entitled "Fence System & Components," PCT/US86/01992, filed Sep. 23, 1986.

*Primary Examiner*—Peter M. Cuomo
*Attorney, Agent, or Firm*—William A. Behare

[57] ABSTRACT

A metal fence (20) is constructed by a fence system with components including clips (26), fence posts (22) allowing rails (24) to engage with the posts and caps (21) to cover the seam between the rails. A solid wall fence (50) can be constructed using fasteners (228, 62), posts (58) and rails (32, 52, 54, 56, 60). Rails (32, 52, 54, 56, 60) slide along a channel (36) to form an interlocking seam (34).

15 Claims, 4 Drawing Sheets

U.S. PATENT DOCUMENTS

| | | | |
|---|---|---|---|
| 4,100,711 | 7/1978 | Skuran | 52/588 X |
| 4,114,860 | 9/1978 | Parisien | 256/65 |
| 4,143,495 | 3/1979 | Hintz . | |
| 4,149,700 | 4/1979 | Stafford | 256/24 |
| 4,188,019 | 2/1980 | Meredith | 256/24 |
| 4,192,117 | 3/1980 | Heirich | 52/588 X |
| 4,196,552 | 4/1980 | Bartlett . | |
| 4,198,034 | 4/1980 | Svirklys | 256/65 |
| 4,202,532 | 5/1980 | Mills | 256/24 |
| 4,272,060 | 6/1981 | Stafford | 256/24 |
| 4,274,506 | 6/1981 | Blomgren et al. . | |
| 4,278,146 | 7/1981 | Lerner et al. . | |
| 4,306,631 | 12/1981 | Reusser . | |
| 4,312,166 | 1/1982 | Mock | 256/24 X |
| 4,325,457 | 4/1982 | Docherty et al. . | |
| 4,330,046 | 5/1982 | Lerner et al. . | |
| 4,358,090 | 11/1982 | Glaesener . | |
| 4,364,546 | 12/1982 | Lyman et al. | 256/73 X |
| 4,369,953 | 1/1983 | Greiner et al. | 256/24 |
| 4,416,349 | 11/1983 | Jacobs . | |
| 4,423,854 | 1/1984 | Cobb et al. . | |
| 4,434,592 | 3/1984 | Reneault et al. . | |
| 4,561,233 | 12/1985 | Harter et al. | 52/542 X |
| 4,566,558 | 1/1986 | Link, Jr. et al. . | |
| 4,609,185 | 9/1986 | Prater et al. | 256/65 |
| 4,801,128 | 1/1989 | Taylor | 256/68 |

FENCE SYSTEM AND COMPONENTS

This application is a continuation of U.S. application Ser. No. 07/142,851, filed as PCT US86/01992 on Sep. 23, 1986, now abandoned.

TECHNICAL FIELD

The present invention pertains to fence systems and components, and, more particularly, to a fence system that can be employed to provide containment, decoration, noise insulation, and security in residential, industrial, government and commercial applications.

BACKGROUND ART

The use of fencing is important in many applications. Fences of a solid-wall construction, that is, fences forming a solid barrier, are commonly used in industrial and construction applications. A properly constructed solid-walled fence can provide a secure industrial environment while preventing noise that is produced by industrial activity from leaving the industrial area. Thus, a solid-walled fence can act as a noise barrier, allowing industrial activity to occur in a residential area with reduced noise disturbance to the residents. Solid-walled fences can be used also as noise barriers to prevent noise generated by highway construction from invading adjoining residential areas. Solid-walled fences used as noise barriers can define single or double solid barriers. The space between the walls of double solid barriers either can be empty or can be filled with a sound absorbing material.

Another important use of solid-walled fences occurs in military and government applications. Solid-walled fences can be used to define boundaries during war games, provide security at military bases and provide a secure environment for government installations in foreign countries.

Fences of open construction, that is, fences that are formed from vertically spaced horizontal rails, are used to contain livestock. Open-walled fences used to contain livestock must be strong enough to resist forces exerted by the livestock on the fence, and their specific construction depends on the type of livestock contained.

Both open-walled and solid-walled fences find major use in residential applications. Open-walled fences are used to define property boundaries, while solid-walled fences are used to provide noise and privacy barriers and to provide security.

Clearly, the various applications described above require fences having different characteristics. Available fence systems generally are well-suited for only one application.

Therefore, there exists a need for a fence system whose components can be used to build fences addressing the needs of all the fencing applications described above.

DISCLOSURE OF INVENTION

The present invention provides fencing components and a fencing system that provide for the construction of fences to meet a variety of needs and that are flexible in design. The present invention further provides fences constructed from the components.

The fencing components include support posts and rails. There are many ways to attach the rails to the posts. For example, the rails may be riveted, screwed, nailed or adhesively attached to the posts. Also, clips (which are provided by the present invention) may be attached to the posts and the rails may be slid over the clips to secure the rails to the posts.

Preferably, each post is constructed of metal and defines at least one rib, that is, the post has a bend in it. The ribs in the posts increase the strength of the posts. The ribs may be formed by methods known to those persons skilled in the art of bending and forming metal sheet material. If added strength is needed, the hollow post can define more than one rib. If additional stability is needed when the post is mounted to a surface, the hollow post can be filled with any one of a variety of materials that exhibits some degree of bonding to steel, for example, concrete, cement or dirt. Also, from the standpoint of strength, it is preferred that the posts are not square in cross section but are rectangular. The posts can be constructed from individual pieces of metal or may be formed from one piece of metal. In both cases, preferably, an interlocking seam is used to join the ends of the metal together to form the hollow post. The post may be pretreated to provide for an aesthetically pleasing structure.

Also preferably, the rails provided by the present invention are constructed of metal and are also ribbed. Ribbing the rails increases the strength of the rails, which in turn increases the security provided by the fencing system. Preferably, the edges, or rims, along the length of the rail are bent away from the exposed face of the rail. The bent rims form channels, which, if properly configured, provide a means of attaching the rail to the post when using a clip attachment of the type disclosed herein. The strength and stability of the fence can also be increased by using clips that are ribbed in the same manner as the rails. Those skilled in the art will appreciate that the added surface contact between hanger and rail imparts rigidity and strength to the fencing system.

The rail channels also help preserve the aesthetic quality of the rail. If the rails are constructed of metal, they may be prone to rusting even if the rails are pretreated. The edges of a piece of metal usually are prone to rusting earlier than are other areas of the piece. By bending the rims to form channels, the rusting metal edges can be hidden from view so that the aesthetic quality of the rail, and consequently the fence system, is preserved. The channel also provides a trap for rusty water flowing away from the edge of the rail that hides the rusty water from view.

Preferably, the fencing system provided by the present invention includes the posts and rails provided by the present invention. Depending on the application of the fencing system, the posts may have one or more ribbed sides and one or more nonribbed sides. The posts may also be filled with materials of the type described above. For example, to form a noise barrier, the fencing system forms a solid barrier consisting of interlocked rails. The fencing system preferably includes posts that have two nonribbed surfaces and two ribbed surfaces, which are mounted in such a manner that the nonribbed surfaces are parallel to each other. To form the solid noise barrier, some of the rails are attached to the nonribbed surfaces of the post. The remaining rails that are needed to complete the solid barrier are then slid along the channels of rails that are either attached to the posts or already interlocked to the attached rails. Finally, fasteners can be used to secure to the posts those rails that were not directly secured to the posts. The interlocking rails, thus, allow for quick erection of the noise barrier. A noise barrier can also be constructed where all of the rails are attached to the nonribbed surfaces of the posts using hangers, or clips, the top and bottom rims of the rails abutting against one another instead of being interlocked with each other. Using clips does not require sliding the rails along the channels of the rails. The resulting void existing between the back faces of the rails can be filled with noise-dampening materials, for example, polyvinyl chloride chips or foam.

There are a variety of ways to attach the rail to the post to construct a fence. For example, wooden posts can be used and the rails can be attached to the posts using, for example, nails, screws or rivets.

Also, preferably, the fencing system includes the posts and rails described above, but employs hangers or clips to secure the rails to the posts. The clips are attached to the post so that the rails can be slid over and along the clips. The rails can be mounted perpendicular, parallel or at any other orientation relative to the posts, depending on the orientation of the clips relative to the posts. The clips can be ribbed to follow the ribbing of the rails. The use of the clips or hangers allows the rails to be attached to the posts without puncturing the rail, which removes a source of potential degradation due to corrosion and helps to preserve the security and aesthetic qualities of the fencing system. Use of clips further allows for flexibility in design of the fence. For building fences on irregular terrain, sections of the clips can be removed to facilitate the construction of a continuous fence.

Caps can be provided to cover seams formed during fence construction. Seams are formed, for example, where the ends of two rails meet. Even though the rails are galvanized and coated to prevent corrosion, the seams are potential sites for corrosion to begin because the cut ends of the rails are neither galvanized nor coated. Placing caps over the joints will further protect the metal against rust. The caps can be similarly ribbed to follow the ribbing of the rails and can be made of the metal described above or of plastic.

In summary, industrial, commercial, residential and governmental users are provided with a fencing system, which can include posts, rails and attaching apparatus, which allows for flexibility of a fence design.

BRIEF DESCRIPTION OF DRAWINGS

The following description of the modes for carrying out the invention can be understood better if reference is made to the drawings, in which.

MODES FOR CARRYING OUT THE INVENTION

Figures 1, 2, 3:
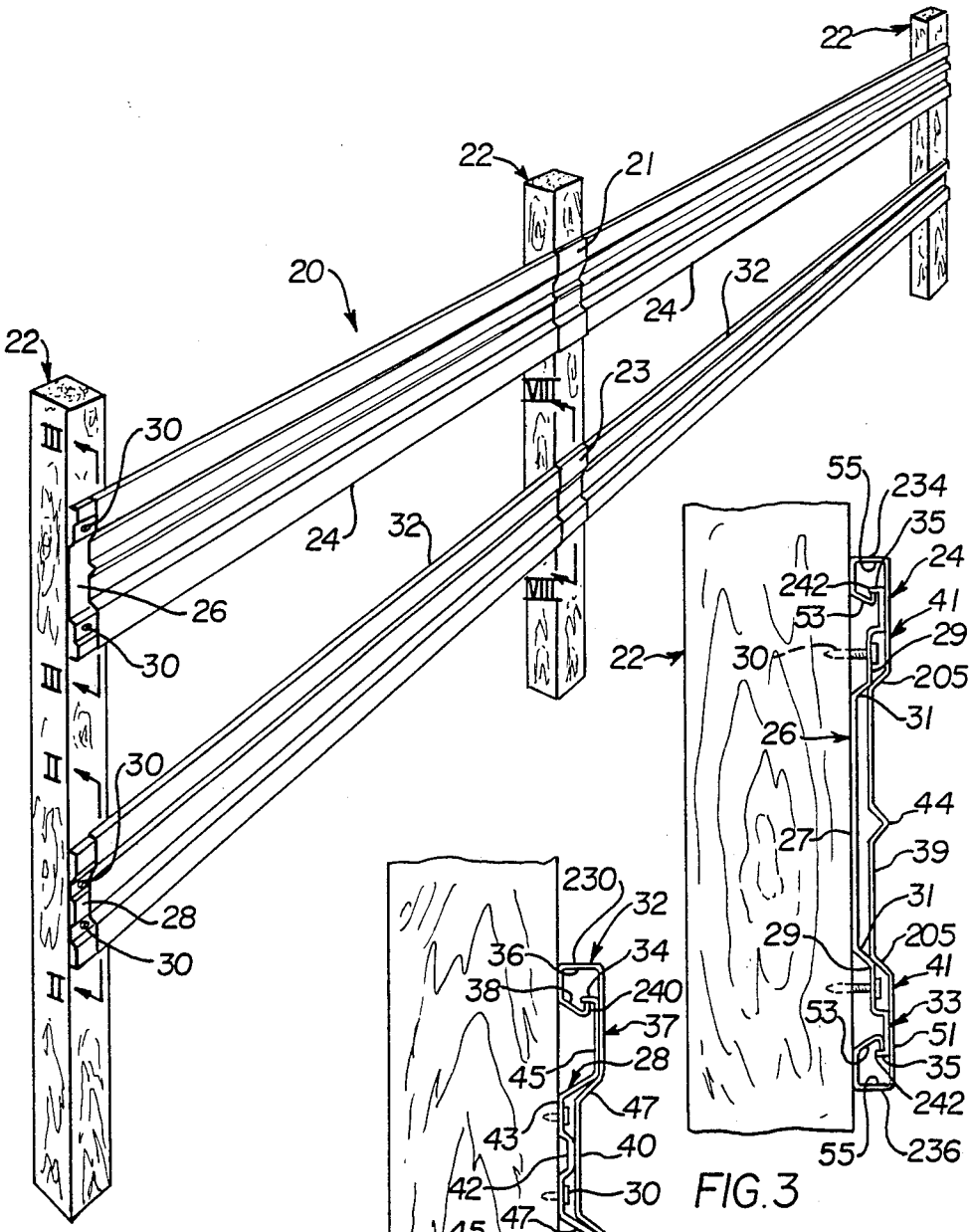
FIG. 1 is an isometric view of an open-walled fence fabricated in part from components constructed according to the provisions of the present invention.
FIG. 2 is a sectional view of the fence shown in FIG. 1 taken along line II—II.
FIG. 3 is a sectional view of the fence shown in FIG. 1 taken along line III—III.
Figure 4:
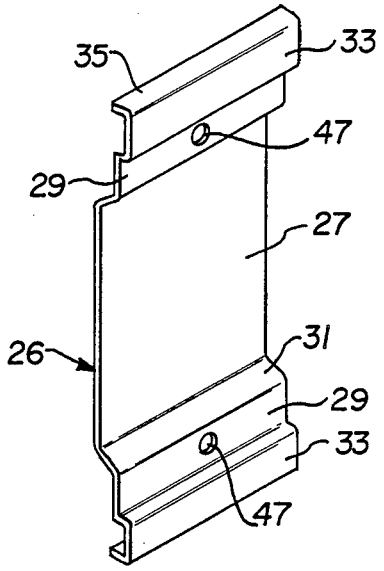
FIG. 4 is an isometric view of one of the clips shown in FIG. 1.
Figure 5:
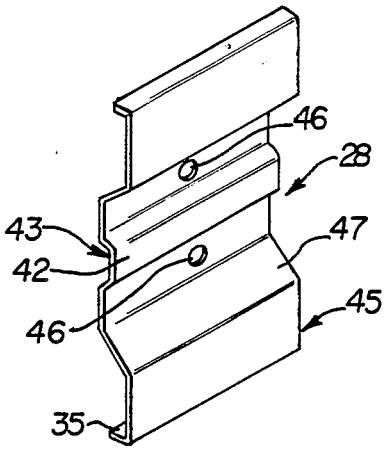
FIG. 5 is an isometric view of one of the clips FIG. 1.
Figure 9:
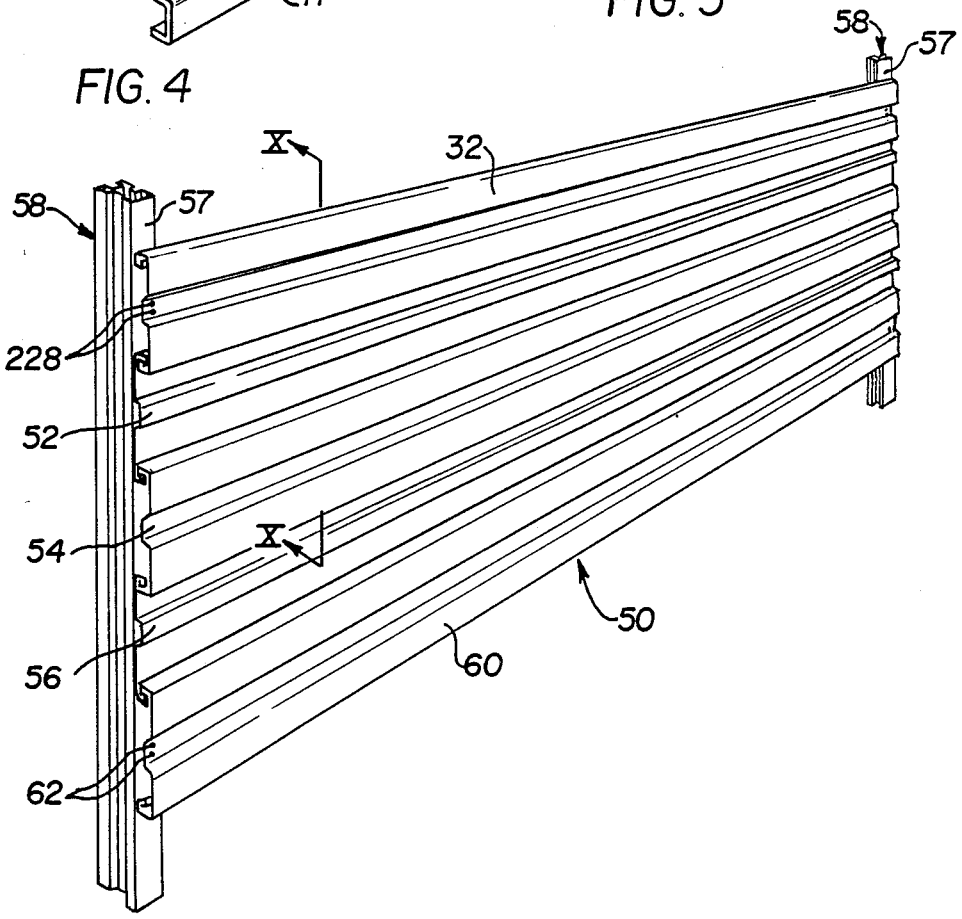
FIG. 9 is an isometric view of a closed-wall fence fabricated from components constructed according to the provisions of the present invention.
Figure 13:
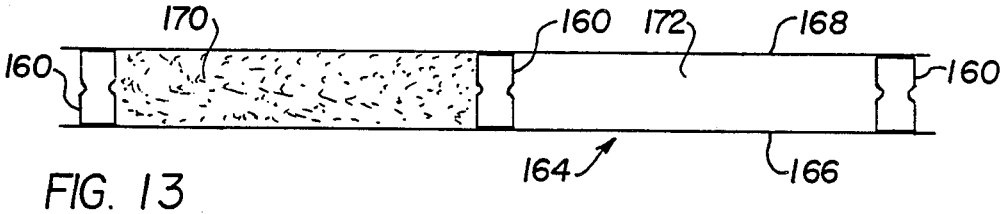
FIG. 13 is a top diagramatic view of a double barrier closed-wall fence formed from components constructed according to the provisions of the present invention.

The present invention provides a fence system of rails, clips and posts, and fences constructed with those components. The components preferably are made of steel and are formed using metal forming techniques known to those of ordinary skill in the art. FIGS. 1, 9 and 13 show the preferred embodiments of the fences provided by the present invention and the preferred clips and rails provided by the present invention. The rails of the fences shown in FIGS. 1, 9 and 13 can be secured with suitable fasteners directly to the posts, but preferably are secured to the posts using clips of the type shown in FIGS. 4 through 6. The fences shown in FIGS. 1, 9 and 13 are examples of fences that can be constructed with the fence system provided by the present invention. Clearly, the fence system can be used to fabricate other types of fences.

FIG. 1 shows a fence of open-walled construction in which wooden supports, or posts, are employed. Open-walled fences are particularly well suited for use in residential areas and in containing livestock. FIG. 9 shows a fence employing solid construction and metal supports. The solid-walled fence shown in FIG. 9 is particularly useful as a privacy and security fence as well as a noise barrier. FIG. 13 shows a fence of the double solid-walled type employing metal posts. Fences having double-walled construction are particularly well suited for use as noise barriers. The space between the solid barriers either can be empty or can be filled with a sound dampening material. The fence constructions shown in FIGS. 1, 9 and 13 are described in more detail below.

FIG. 1 shows a fence 20. Fence 20 is formed from rails 24 and 32 and clips 26 and 28, which are fence system components provided by the present invention. Fence 20 also includes wooden posts 22 and caps 21 and 23. Clips 26 and 28 are employed to secure rails 24 and 32, respectively, to posts 22. Clips 26 and 28 and rails 24 and 32 preferably are constructed from A525 annealed and galvanized steel. The steel should be annealed prior to forming clips 26 and 28 and rails 24 and 32 to ensure that the steel is flexible enough to permit forming those components without cracking the steel. As is known in the art, galvanizing the steel provides clips 26 and 28 and rails 24 and 32 that are less susceptible to corrosion than components formed from steel that is not galvanized. The spacing between posts 22, the spacing between rails 24 and 32, and the number and type of rails 24 and 32 and posts 22 employed depends on the application and aesthetics, and easily can be determined by those of ordinary skill in the art.

As can be seen from FIGS. 1, 2 and 3, rails 24 and 32 are secured to posts 22 by sliding them over clips 26 and 28, respectively. Each clip 26 and 28 is sized to match the height of each rail 24 and 32, to permit rails 24 and 32 to be properly slid onto clips 26 and 28. As can be seen in FIG. 2, each clip 28 defines a seating surface 43 that is used to secure clip 28 to a post, for example wooden post 22 shown in FIG. 2. Clip 28 also defines a pair of rail engaging segments 45, each of which defines a flange 34. Flanges 34 make contact with and fixes the position of a rail 32. Clip 28 also defines a pair of spacing segments 47, which space engaging segments 45 from post 22 to permit rail 32 to be slid onto clip 28. Each clip 28 defines a rib 42, which provides added strength for clip 28. Finally, each clip 28 defines a pair of holes 46 through which suitable fasteners may be inserted to secure clip 28 to post 22.

Each rail 32 defines a rib 40 and a clip engaging section 37. Rib 40 provides strength to rail 32 and adds to its appearance. Rail 32 defines a clip engaging segment 37. Clip engaging segment 37 defines a channel 36 (which is used to permit solid barriers to be formed by rails 32, as is described in more detail below) and lip 38. Clip engaging segment 37 of rail 32 and rail engaging segment 45 of clip 28 are so sized and shaped that rail 32 is positively engaged with clip 28 when rail 32 is slid over clip 28. In particular, segment 203 of clip 28 engages segment 201 of rail 32 while lips 38 of rail 32 engage flanges 34 of clip 28. A slightly loose fit between lips 38 and flanges 34 is preferable to permit rail 32 to rotate slightly on clip 28 during construction of fence 20 to allow for uneven terrain. However, segments 37 and 45 should be snugly engaged. Otherwise, rattling of clip 28 against post 22 could occur when wind blows against fence 20. If formation is seriously inadequate, disengagement of rail 32 and clip 28 from post 22 could occur.

FIG. 3 shows clip 26 and rail 24 secured to a post 22. Clip 26 defines seat 27, which stabilizes the position of clip 26 when it is secured to a post 22. Clip 26 further defines fastening segments 29, each of which defines an opening 47 through which suitable fasteners are inserted to secure clip 26 to post 22. Clip 26 defines a pair of spacing segments 31, which are used to space segments 29 a desired distance from post 22. Finally, clip 26 defines a pair of rail engaging segments 33, each of which defines a flange 35 that engages rail 24.

Each rail 24 defines a central portion 39 that further defines a rib 44. Rib 44 is used for wider rails where additional resistance to twisting and flexing is desired. Rail 24 defines a pair of clip engaging segments 41. Each segment 41 defines a segment 51 that engages segment 33 of clip 26. Each segment 41 also defines a channel 55 and a lip 53. Lip 53 engages flange 35 to secure rail 24 to clip 26 when rail 24 is slid over clip 26. Finally, each segment 41 defines a spacing segment 205, which spaces a segment 51 a desired distance from a fastening segment 29 of clip 26. Segments 31, 33 and 41 are sized and configured to permit positive engagement between rail 24 and clip 26 when those components are secured together. In particular, segments 31, 33 and 41 are configured to permit segments 31 and 205 and segments 51 and 33 to contact each other while lip 53 engages flange 35.

It should be noted that the precise nature of any fence constructed with components shown in FIGS. 1 through 6 will depend to a great extent on the application in which it will be used. Any desired combination of the components can be achieved to construct any type of open-walled fence.

To construct fence 20, posts 22 are secured in a base, which could be, and usually is, earth. Rails 24 and 32 may be fastened directly to posts 22. However, it is preferable to use clips 26 and 28 to secure rails 24 and 32 to posts 22. A clip 26 is secured to each post 22 with fasteners 30. Clips 26 must be so aligned relative to each other that rail 24 can be slid onto clips 26. Mounting of rail 24 to posts 22 is completed by sliding rail 24 onto clips 26. Similarly, clips 28 are mounted to posts 22 by fasteners 30, and rail 32 is slid onto clips 28.

Figure 8:
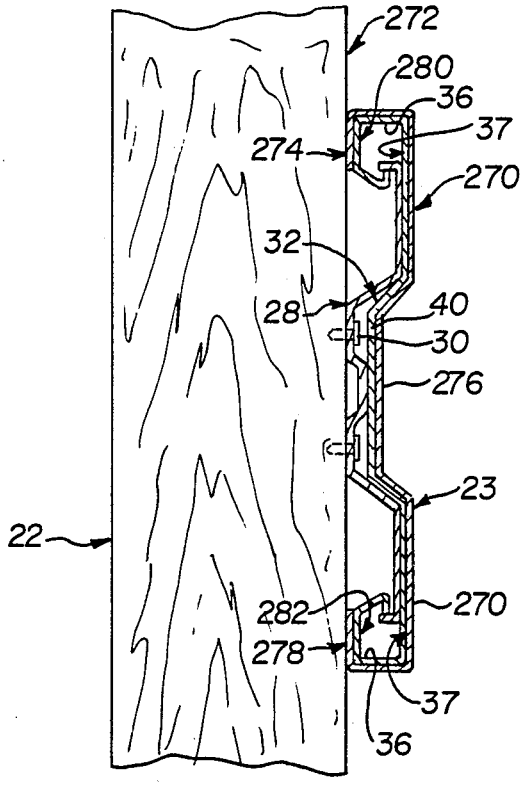
FIG. 8 is a sectional view of the fence shown in FIG. 1 taken along line VIII—VIII.

Caps 21 and 23 are shown in FIG. 1. Caps 21 and 23 are so sized and configured to snap and fit snugly over rails 24 and 32, respectively. Placement of cap 23 on rail 32 is more clearly shown in FIG. 8. It will be appreciated that the placement of cap 21 on rails 24 is similar to that of cap 23 on rails 32. The configuration of post 22, clip 28, fastener 30 and rail 32 are described above. Cap 23 is fit onto rail 32 by placing edge 274 of cap 23 between face 272 of post 22 and edge 280 of rail 32. As edge 278 is snapped between face 272 of post 22 and edge 282 of rail 32, rail engagement sections 270 and 276 of cap 23 positively engage rib 90 and segment 37 of rail 32. Cap 23 similarly engages rail 24.

It should be noted that lips 38 of rail 32 and lips 53 of rail 24, along with channels 36 and 55, respectively, provide a way of removing water, from rain or early morning dew, for example, from edges 240 and 242 of lips 38 and 53, respectively. Removing water helps to prevent rust from occurring. If rust does occur on edges 240 and 242 of lips 38 and 53, respectively, lips 38 and 53 hide from view the rust on edges 240 and 242, respectively, so that the appearance of the fence is not affected. Further, rusty water produced at edges 240 and 242 is collected in channels 36 and 55 to hide it from view.

Figure 6:
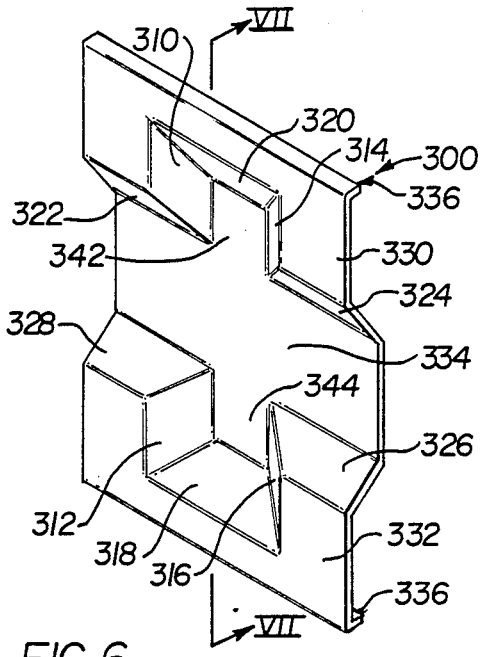
FIG. 6 is an isometric view of an alternate construction of a clip.
Figure 7:
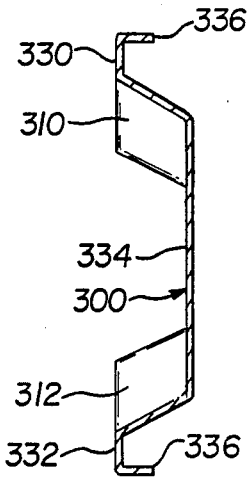
FIG. 7 is a sectional view of the clip shown in FIG. 6 taken along line VII—VII.

FIGS. 6 and 7 show clip 300. Clip 300 is sized and configured to permit rails 24 or 32 to slide onto it. Clip 300 defines faces 330 and 332, which are identical in size and shape. Rail engagement section 334 is so sized and shaped to positively engage with the posterior side of rib 40 of rail 32. Faces 330 and 332 of clip 300 are also sized and configured to permit clip engagement segment 37 of rail 32 to positively engage clip 300 when rail 32 is slid over clip 300. In particular, segment 332 of clip 300 engages segment 201 of rail 32 while lips 38 of rail 32 engage flanges 336 of clip 300. Faces 322, 324, 326 and 328 of clip 300 are identical in size and configuration and are so sized and shaped to permit positive engagement of segment 51 of rail 32 when rail 32 is slid over clip 300. Segments 310, 312, 314 and 316 are identical in size and shape. Segments 318 and 320 are also identical in size and configuration. Additionally, faces 342 and 344 are identical in size and shape. The configuration of segments 310, 320, 314 and face 342 facilitate the acceptance of the working end of a rivet gun used in the attachment of clip 300 to a post 22 or a post 58, described below. Rivets, among other fasteners, can be used to attach clip 300 to a post 22 or post 58. Fastening can be accomplished using a rivet gun, sold under the designation "ASN-1" by Stanley-Bostitch, a subsidiary of Stanley Works, with offices in Rhode Island. The ASN-1 rivet gun drives a threaded rivet through clip 300 into the post and then rotates the rivet to tighten the rivet into the post.

FIG. 9 shows a solid-walled fence 50 employing metal supports. Fence 50 is formed from rails 32, 52, 54, 56 and 60 and fasteners 228 and 62, which rails are fence system components provided by the present invention, and shown in detail in FIGS. 1 through 3. Fence 50 is also constructed from metal posts 58, rather than posts 22, which are described in more detail below. Rails 52, 54, 56 and 60 are identical to rail 32 shown in FIGS. 1 and 2, and fasteners 228 and 62 are identical to fastener 30 shown in FIGS. 1 through 3.

Figure 10:
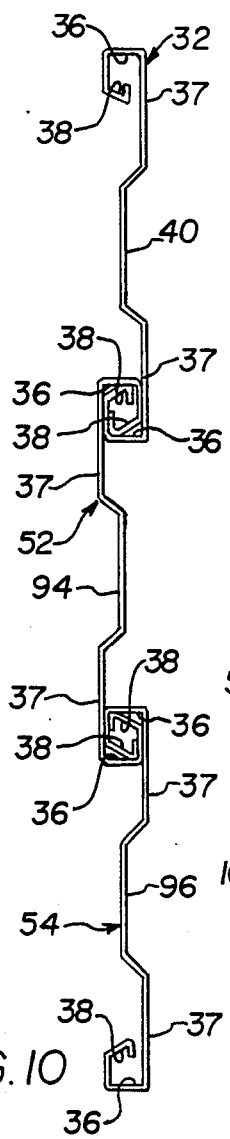
FIG. 10 is a sectional view of the fence shown in FIG. 6 taken along line X—X.

As can be seen from FIGS. 9 and 10, rails 32 and 60 are secured to posts 58 by using fasteners 228 and 62, respectively. Channels 36, lips 38, and segments 37 of the rails shown in FIG. 9 are so sized and shaped that channels 36 of adjacent rails can be slid together and interlocked, as shown in FIG. 10, to form a solid barrier. Improper formation of segments 36, 37 and 38 of rails 32 and 52 could result in sloppy engagement, which could cause rattling and noise when wind blows against fence 50 and, possibly, disengagement of rail 32 from rail 52. Rails 52, 54 and 56 also can be secured to posts 58 using fasteners 30. Again, the height and width of fence 50 and the spacing and number of posts 58 can be chosen by those of ordinary skill in the art to meet specific applications.

Fence 50 can also be constructed using the open, or noninterlocked, fence construction used to construct fence 20 discussed above. Clips 26 or 28 may be attached to posts 22 or 58 using fasteners 30 such that when rails identical to rail 24 or rail 32 are slid over clips 26 or 28, as discussed above, exterior bottom rim 232 of rail 32 will slide along and abut against exterior top rim 230 of a rail identical to rail 32. Similarly, exterior bottom rim 236 of rail 24 can slide along and abut against exterior top rim 234 of a rail identical to rail 24. Clearly, the clips must be so fastened to the posts that the rims of the rails contact each adjacent rim when the rails are slid over the clips to form a solid barrier.

Figure 11:
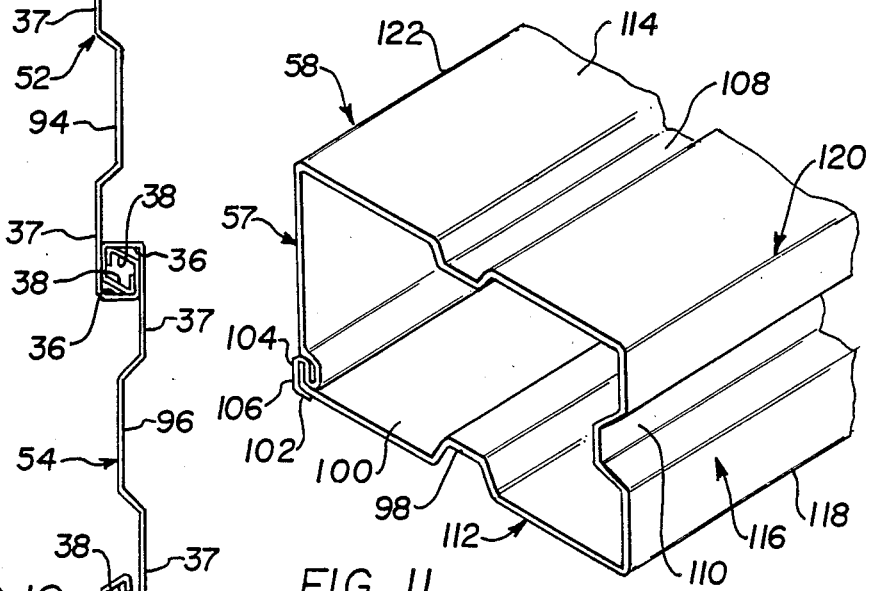
FIG. 11 is an isometric view of a section of one of the posts shown in FIG. 6.

FIG. 11 shows an isometric view of metal post 58. Preferably, post 58 is constructed from A525 annealed and galvanized steel. Again, the steel should be annealed prior to forming post 58 to ensure that the steel is flexible. Post 58 defines ribbed panels 112, 114 and 116. Metal posts should be used in applications where all posts must provide consistent resistance to force. For example, due to inconsistencies in sizing of and the presence of irregularities, such as knots, in wooden posts, which weaken wooden posts, metal posts may be desirable in certain applications. Ribbed panels 112, 114 and 116 further define ribs 98, 108 and 110, respectively. Ribs 98, 108 and 110 are incorporated into post 58 to provide additional resistance to twisting and flexing. Post 58 further defines a nonribbed panel 57. During the construction of fence 50, clips 28 and 62 are attached to panel 57 with fasteners 30 to ensure good contact between seating surface 43 of clip 28, and the seating surface of clip 62 and panel 57. Post 58 is formed by bending ribbed metal stock at bends 118, 120 and 122 such that ribbed panel 112 is parallel to ribbed panel 114 and ribbed panel 116 is parallel to nonribbed panel 57. Edge 104 of panel 57 engages end 102 of panel 112 to form seam 106. Cavity 100 of post 58 results after the construction of post 58. Cavity 100 is adapted to receive any monolithic material that exhibits some degree of bonding to metal (for example, earth) to stabilize post 58 when it is secured to a supporting surface.

Figure 12:
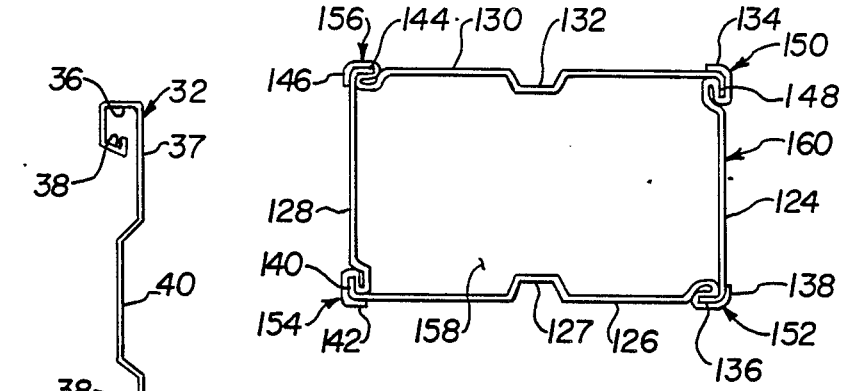
FIG. 12 is a sectional view of an alternate construction of a metal post provided by the present invention.

FIG. 12 shows a cross section of post 160, another embodiment of a post provided by the present invention. Post 160 is particularly useful in the construction of fence 164, described in more detail below. Post 160 defines nonribbed panels 124 and 128 and ribbed panels 126 and 130, which further define ribs 127 and 132, respectively. The arrangement of panels 124, 126, 128 and 130 is such that panels 124 and 128 are parallel to one another and panels 126 and 130 are parallel to one another. Panels 124, 126, 128 and 130 are constructed of steel heretofore described, and annealed and galvanized for the reasons stated above. Post 160 is formed by engaging flange engagement channel 134 of panel 129 with flange 148 of panel 130 to form seam 150. Flange engagement channel 146 of panel 130 interlocks with flange 144 of panel 128 to form seam 156. Flange engagement channel 142 of panel 128 engages flange 140 of panel 126 to form seam 154. Flange engagement channel 138 of panel 126 interlocks with flange 136 of panel 124 to form seam 152. Cavity 158 is formed when panels 124, 126, 128 and 130 are arranged and interlocked by seams 150, 152, 154 and 156. Cavity 158 may be filled with materials of the type described above that increase the stability of post 160 when it is set in a supporting surface.

FIG. 13 shows diagrammatically a top view of a fence 164. Fence 164 is constructed from posts 160 and rail assemblies 166 and 168. Each barrier 166 and 168 is identical to the barrier shown in FIG. 9. However, since a solid barrier must be mounted to two parallel sides of a post, posts 160, which define two parallel flat sides, are used, rather than posts 58. The number and placement of posts 160 depend on the height, strength and use of fence 164 desired. Preferably, panels 124 and 128 of each post 160 are placed parallel to one another to provide an appropriate surface for mounting rail assemblies 166 and 168. Panels 126 and 130 of each post 160 are necessarily perpendicular to rail assemblies 166 and 168. Rail assemblies 166 and 168 are constructed in the same manner as the barrier of fence 50 shown in FIGS. 9 and 10 or from the alternate construction based on fence 20 discussed above. For example, a rail, sized to match rail 32, is secured by fasteners, sized to match fasteners 228, to the top of each of panels 124 and 128 of each post 160. Similarly, a rail, sized to match rail 60, is secured by fasteners, sized to match fasteners 62, to the bottom of each of panels 124 and 128 of each post 160. Rails to complete fence 164 are positively engaged as described above in the construction of fence 50, shown in FIGS. 9 and 10. When rail assemblies 166 and 168 are constructed, space 172 is formed. Space 172 can be filled with sound dampening material, as shown in space 170, to further reduce sound levels.

Preferably, the metal components described above are formed from A525 annealed and galvanized steel and coated with a polyvinyl chloride coating. Further, for decorative and aesthetic quality, it is preferable that the galvanized metal used to construct the posts and rails be coil-coated on both sides with a polyvinylidene fluoride coating, sold under the trademark "HALOMET IV", a Glidden Chemical Coatings product manufactured by the SCM Corporation, Cleveland, Ohio, which gives excellent durability to the components due to its outstanding resistance to ultraviolet radiation and chemical degradation. After coating, the metal can be embossed to give the appearance of a wood grain. The metal may also be coated with a fluorescent coating to allow easier identification of the fence system at night.

Deflection data describing the strength of the metal posts described above and demonstrating differences in toughness between a metal post and a wooden post are presented below.

| LOAD (lbs.) | DEFLECTION (inches) METAL POST[1] | WOOD POST I[2] | WOOD POST II[3] |
|---|---|---|---|
| 100 | 3/16 | 7/16 | 10/16 |
| 200 | 9/16 | 14/1 | 10/16 |
| 300 | 23/32 | 1 6/16 | 1 inch |
| 350 | 27/32 | 1 11/16 | 1 4/16 |
| 400 | 1 ⅛ | 2 2/16 | 1 7/16 |
| 475 | | TOTAL FAILURE[4] | |
| 500 | | | 1 12/16 |
| 1350 | | | 3 2/16 |
| 1600 | NO FAILURE | | NO FAILURE; CONCRETE BASE PULLED OUT |

[1]Two ribbed surfaces
[2]Wood grain parallel to load
[3]Wood grain perpendicular to load
[4]Failure occurred at knot in wood The data show the metal post deflects less over a wide range of applied loads compared to a wood post. Metal posts are also devoid of potential failure sites, such as knots in wood posts. It is necessarily important that fence posts be resilient when placed in areas where the fence system may be subjected to severe stress; for example, containment of livestock.

The fence system includes a fence post and a plurality of interconnected fence rails for being connected to the fence post. Each fence rail includes an elongated rail member defining a longitudinal axis and an axis which is transverse to the longitudinal axis. Each rail member has a first end, a second end, a third end and a fourth end. The first and second ends are positioned at opposite ends of the longitudinal axis of the elongated rail member and the third and fourth ends are positioned at opposite ends of the transverse axis.

The third and fourth ends, each, are formed with a first bend, a second bend, a third bend and a fourth bend. Each bend extends generally continuously from the first end to the second end. The first bend is formed at an acute angle, the second bend is formed in an obtuse angle and the third and fourth bends, each, are formed at generally a right angle.

The third and fourth ends form an interlocking connector to allow one of the third and fourth ends of a first rail to be interconnected with one of the third and fourth ends of a second rail, The elongated rail has means for attachment to the fence post.

The fence post includes at least one panel having a first edge and a second edge. The first edge is formed with a fifth bend defining, generally, a right angle and the second edge is formed with sixth and seventh bends, each, defining a generally U-shape and being connected together by a common member. At least one of the panels is formed in a predetermined configuration to allow the first edge to be positioned at least partially within an area defined by at least one U-shape bend of the second edge.

Industrial Applicability

The way in which the present invention is capable of exploitation in industry and the way in which it can be made and used is deemed to be obvious from the description or nature of the invention.

We claim:

1. A fence system comprising:

fence post means for being vertically mounted; and a plurality of interconnected fence rail means for being horizontally mounted and for being connected to said fence post means, each said fence rail means comprising:

(a) an elongated rail member defining a longitudinal axis for being horizontally disposed and an axis which is transverse to said longitudinal axis and having a first end, a second end, a third end and a fourth end, said first and second ends being positioned at opposite ends of said longitudinal axis of said elongated rail member and said third and fourth ends being positioned at opposite ends of said transverse axial;

(b) said third and fourth ends each being generally symmetrical with one another;

said third and fourth ends each having an extreme end portion;

each said extreme end portion being formed in sequence a first bend closest to its corresponding extreme end portion, a second bend adjacent said first bend, a third bend adjacent said second bend, and a fourth bend furthest away from its corresponding end portion, each said bend extending generally continuously from said first end to said second end, said first bend being formed at an acute angle, said second bend being formed at an obtuse angle and said third and fourth bends each being formed at a right angle;

(c) said third and fourth ends each defining a cavity and forming an interlocking connector for slidingly interconnecting one of said third and fourth ends of a first of said plurality of rail means with one of said third and fourth ends of a second of said plurality of rail means, said acute angle of said first bend, said obtuse angle of said second bend, said right angle of said third bend and said right angle of said fourth bend being relatively positioned to face their corresponding cavity; and (d) said elongated rail having means for attachment to said fence post means.

2. The fence system of claim 1, wherein said fence post means comprises:

at least one panel having a first edge and a second edge:

said first edge being formed with a fifth bend defining generally a right angle;

said second edge being formed with sixth and seventh bends each defining a generally U-shape and being connected together by a common member; and at least one of said at least one panel being formed in a predetermined configuration to position said first edge to be positioned at least partially within an area defined by at least one said U-shaped bend of said second edge.

3. The fence system of claim 2, wherein:

said fence post means is positioned and anchored to receive said plurality of interconnected fence rail means; and said plurality of interconnected fence rail means are attached to said fence post means.

4. The fence system of claim 3, wherein said fence system is a solid wall fence system.

5. The fence system of claim 4, wherein at least one said interconnected fence rail means is ribbed.

6. The fence system of claim 5, wherein said third and fourth ends of at least one said elongated rail members forms liquid channel means for channeling liquid between said first end and said second end.

7. The fence system of claim 6, wherein:

said fence post means defines a cavity; and said cavity is filled with filter material.

8. The fence system of claim 7, wherein at least one said fence rail means is constructed of steel.

9. The fence system of claim 8, wherein said steel is galvanized steel.

10. The fence system of claim 9, wherein at least one of said fence rail means is annealed.

11. The fence system of claim 10, wherein at least one said fence rail means is riveted to said fence post means.

12. The fence system of claim 11, wherein at least one said fence rail means is coated with a coating.

13. The fence system of claim 12, wherein said coating is polyvinyl chloride.

14. The fence system of claim 13, wherein said steel is A525 steel.

15. The fence system of claim 14, wherein at least a portion of at least one said fence rail means is embossed with a wood appearing type pattern.

* * * * *

UNITED STATES PATENT AND TRADEMARK OFFICE

CERTIFICATE OF CORRECTION

PATENT NO. : 4,964,618

DATED : October 23, 1990

INVENTOR(S) : Charles G. Kennedy, Patrick D. McKeown and Jack W. Neiger

It is certified that error appears in the above-identified patent and that said Letters Patent is hereby corrected as shown below:

Column 10, line 11;
In Claim 1, line 15, after 'transverse', please delete "axial" and insert --axis--.

Column 11, line 4;
In Claim 7, line 3, after 'with', please delete "filter" and insert --filler--.

Signed and Sealed this

Twelfth Day of May, 1992

*Attest:*

*Attesting Officer*

DOUGLAS B. COMER

*Acting Commissioner of Patents and Trademarks*